US012137751B2

(12) United States Patent
Kim et al.

(10) Patent No.: US 12,137,751 B2
(45) Date of Patent: Nov. 12, 2024

(54) AEROSOL GENERATING DEVICE AND OPERATING METHOD THEREFOR

(71) Applicant: KT&G CORPORATION, Daejeon (KR)

(72) Inventors: Jeong Hoo Kim, Cheongju-si (KR); Woo Seok Chung, Namyangju-si (KR)

(73) Assignee: KT&G CORPORATION, Daejeon (KR)

( * ) Notice: Subject to any disclaimer, the term of this patent is extended or adjusted under 35 U.S.C. 154(b) by 797 days.

(21) Appl. No.: 17/294,760

(22) PCT Filed: Oct. 7, 2020

(86) PCT No.: PCT/KR2020/013615

§ 371 (c)(1),
(2) Date: May 18, 2021

(87) PCT Pub. No.: WO2021/071220

PCT Pub. Date: Apr. 15, 2021

(65) Prior Publication Data

US 2022/0015457 A1 Jan. 20, 2022

(30) Foreign Application Priority Data

Oct. 11, 2019 (KR) ..... 10-2019-0126304

(51) Int. Cl.
*A24F 42/20* (2020.01)
*A24B 15/167* (2020.01)
(Continued)

(52) U.S. Cl.
CPC ..... *A24F 42/20* (2020.01); *A24B 15/167* (2016.11); *A24F 7/00* (2013.01); *A24F 42/60* (2020.01);
(Continued)

(58) Field of Classification Search
CPC .. A24F 42/20; A24F 7/00; A24F 42/60; A24F 40/10; A24F 40/20; A24F 40/30;
(Continued)

(56) References Cited

U.S. PATENT DOCUMENTS 3,872,871 A 3/1975 Fiore et al.
10,881,132 B2 * 1/2021 Mua ..... A24B 13/00
(Continued)

FOREIGN PATENT DOCUMENTS

CN 101262786 A 9/2008
CN 103005668 A 4/2013
(Continued)

OTHER PUBLICATIONS

Extended European Search Report dated Dec. 8, 2021 in European Application No. 20874999.4.
(Continued)

*Primary Examiner* — Travis S Chambers
(74) *Attorney, Agent, or Firm* — Sughrue Mion, PLLC

(57) ABSTRACT

An aerosol generating device includes: a liquid storage configured to store a liquid material; an aerosol generating space configured to accommodate a solid material including a tobacco material and a foamable material such that an aerosol is generated as the solid material comes in contact with the liquid material in the aerosol generating space; a liquid transfer tube connected to the liquid storage and the aerosol generating space such that the liquid material moves from the liquid storage to the aerosol generating space; and a mouthpiece configured to discharge the aerosol generated in the aerosol generating space, according to a user's inhalation.

14 Claims, 4 Drawing Sheets

(51) Int. Cl.

| | |
|---|---|
| ***A24F 7/00*** | (2006.01) |
| ***A24F 42/60*** | (2020.01) |
| *A24F 40/10* | (2020.01) |
| *A24F 40/20* | (2020.01) |
| *A24F 40/30* | (2020.01) |
| *A24F 40/485* | (2020.01) |
| *A24F 40/51* | (2020.01) |

(52) U.S. Cl.
CPC ..... *A24F 40/10* (2020.01); *A24F 40/20* (2020.01); *A24F 40/30* (2020.01); *A24F 40/485* (2020.01); *A24F 40/51* (2020.01)

(58) Field of Classification Search
CPC ..... A24F 40/485; A24F 40/51; A24F 40/48; A24F 40/40; A24F 400/46; A24F 40/50; A24B 15/167; A24B 15/16; A24B 15/86
See application file for complete search history.

(56) References Cited

U.S. PATENT DOCUMENTS

| | | | |
|---|---|---|---|
| 2006/0191548 | A1 | 8/2006 | Strickland et al. |
| 2009/0025738 | A1 | 1/2009 | Mua et al. |
| 2013/0152953 | A1 | 6/2013 | Mua et al. |
| 2017/0127722 | A1 | 5/2017 | Davis et al. |
| 2017/0197046 | A1* | 7/2017 | Buchberger ..... A24F 40/44 |
| 2017/0245552 | A1 | 8/2017 | Reevell |
| 2017/0318860 | A1 | 11/2017 | Adair |
| 2018/0140018 | A1 | 5/2018 | Hu et al. |
| 2018/0352862 | A1 | 12/2018 | Mironov et al. |
| 2019/0014819 | A1 | 1/2019 | Sur |
| 2019/0098927 | A1 | 4/2019 | Mironov |
| 2019/0099566 | A1 | 4/2019 | Gramann et al. |
| 2019/0159519 | A1 | 5/2019 | Bowen et al. |
| 2020/0352231 | A1 | 11/2020 | Han et al. |
| 2021/0112848 | A1 | 4/2021 | Mua et al. |

FOREIGN PATENT DOCUMENTS

| | | | |
|---|---|---|---|
| CN | 104039178 | A | 9/2014 |
| CN | 104126875 | A | 11/2014 |
| CN | 108697166 | A | 10/2018 |
| CN | 208192123 | U | 12/2018 |
| EP | 2790535 | B1 | 2/2016 |
| JP | 2015-504658 | A | 2/2015 |
| JP | 6154399 | B2 | 6/2017 |
| WO | 2016/066635 | A1 | 5/2016 |
| WO | 2020/038868 | A1 | 2/2020 |

OTHER PUBLICATIONS

Communication dated Oct. 17, 2023 issued by the European Patent Office in application No. 20874999.4.
Notification of Reason for Refusal of Korean Application No. 10-2019-0126304 dated Feb. 25, 2021.
International Search Report of PCT/KR2020/013615 dated Jan. 15, 2021 [PCT/ISA/210].
Written Opinion of PCT/KR2020/013615 dated Jan. 15, 2021 [PCT/ISA/237].
Office Action issued Sep. 13, 2022 in Japanese Application No. 2021-547545.
Office Action issued Apr. 20, 2023 in Chinese Application No. 202080011431.1.

* cited by examiner

[Fig. 1]
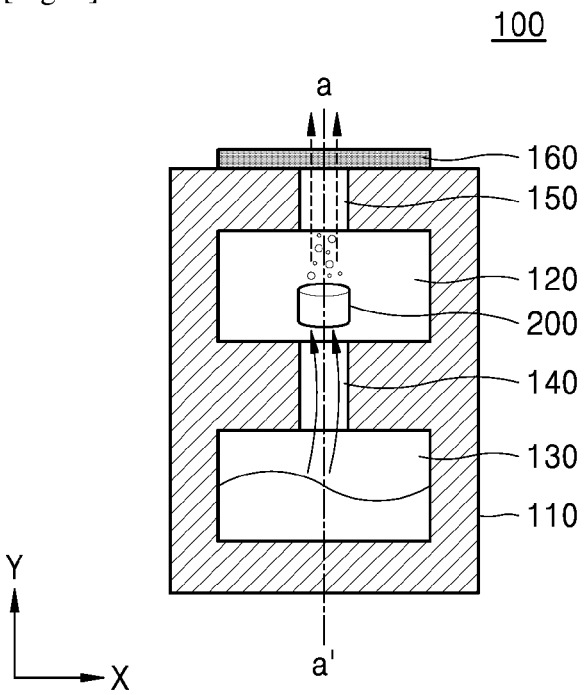
[Fig. 2]
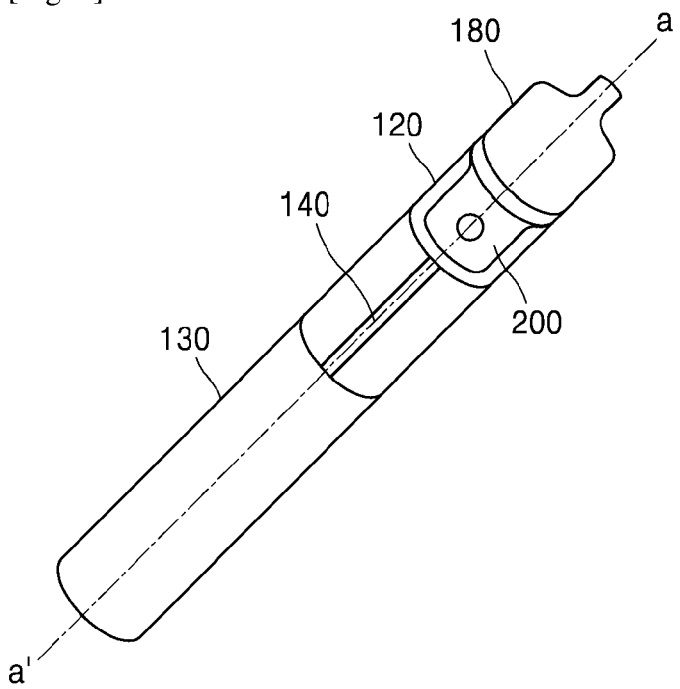

[Fig. 3]
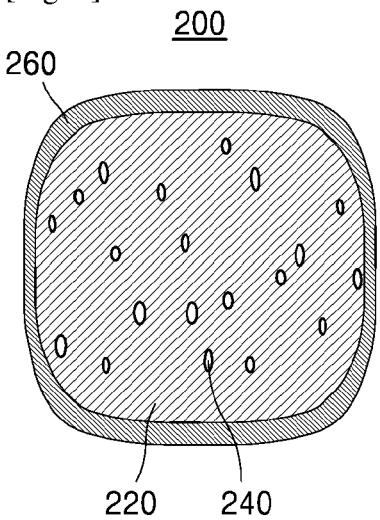
[Fig. 4]
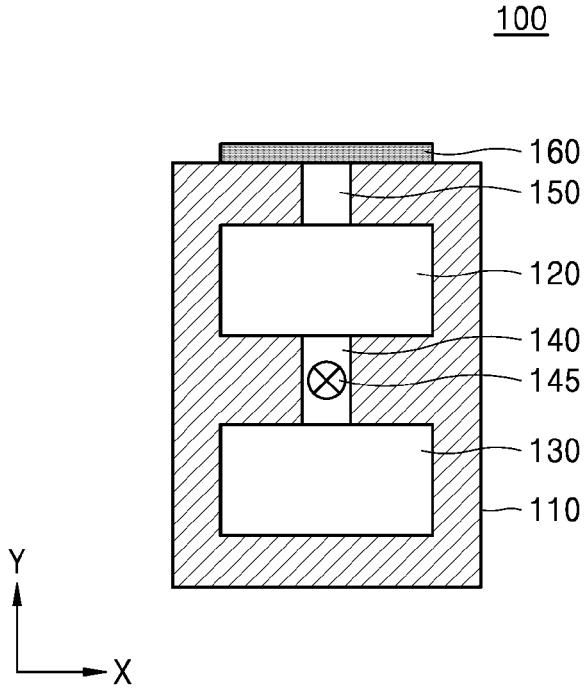

[Fig. 5]
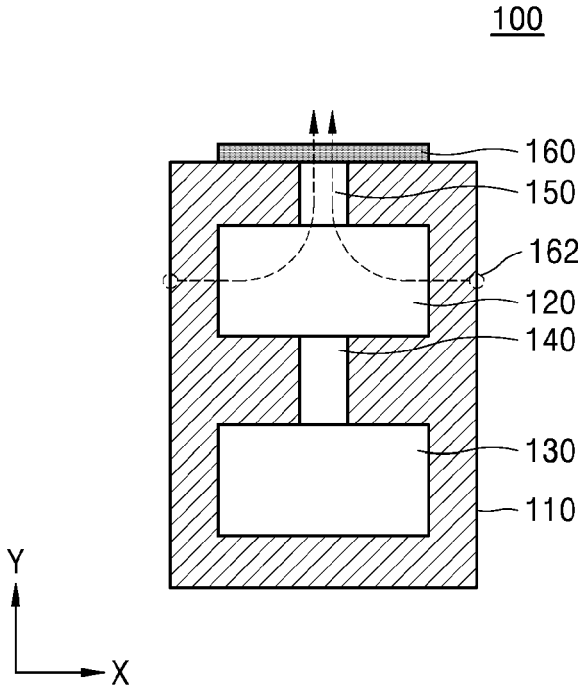
[Fig. 6]
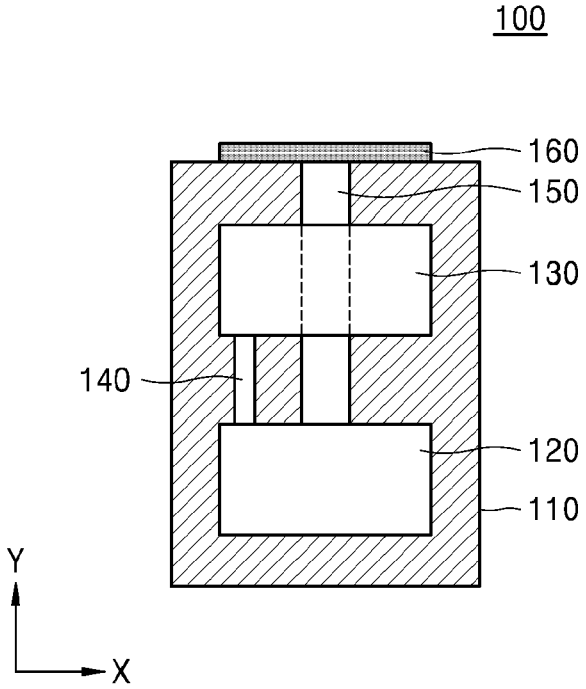

[Fig. 7]
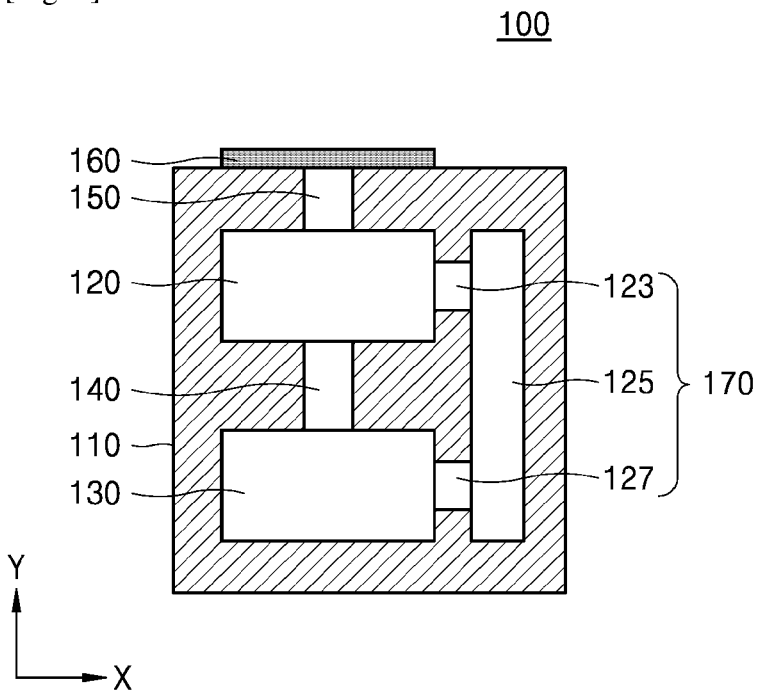
[Fig. 8]
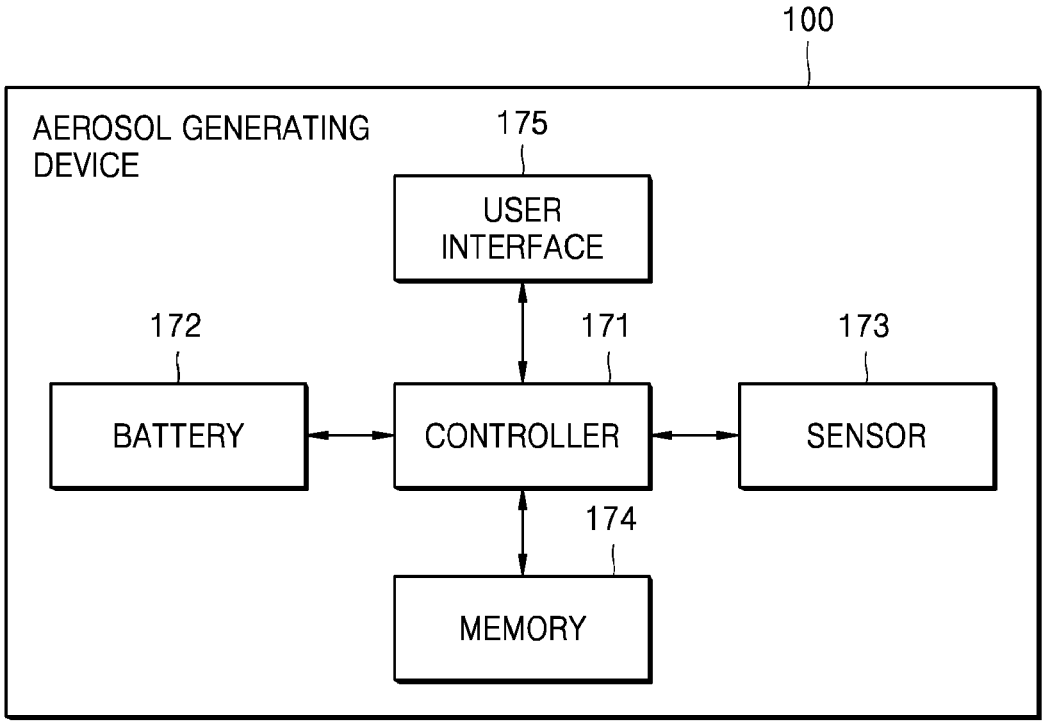

AEROSOL GENERATING DEVICE AND OPERATING METHOD THEREFOR

CROSS REFERENCE TO RELATED APPLICATIONS

This application is a National Stage of International Application No. PCT/KR2020/013615, filed Oct. 7, 2020, claiming priority to Korean Patent Application No. 10-2019-0126304, filed Oct. 11, 2019.

TECHNICAL FIELD

One or more embodiments relate to an aerosol generating device, and more particularly, to an aerosol generating device that may generate an aerosol through a foaming reaction.

BACKGROUND ART

Recently, the demand for alternative methods to overcome the shortcomings of general cigarettes has increased. For example, there is growing demand for an aerosol generating device that generates an aerosol by heating an aerosol generating material, rather than by combusting cigarettes.

However, an aerosol generating device that generates an aerosol by heating the aerosol generating material may consume much power, cause safety problems due to heating, and complicate the design of electronic elements. Thus, there is a need for an apparatus and a method capable of providing a more convenient and safer smoking experience to a user.

DISCLOSURE OF INVENTION

Technical Problem

One or more embodiments include an aerosol generating device in which an aerosol is generated by a foaming phenomenon caused by contact between a certain solid material and a certain liquid material so that the generated aerosol may be provided to a user.

The technical problems of the present disclosure are not limited to the above-described description, and other technical problems may be derived from the embodiments to be described hereinafter.

Solution to Problem

According to one or more embodiments, an aerosol generating device includes a liquid storage configured to store a liquid material; an aerosol generating space configured to accommodate a solid material including a tobacco material and a foamable material such that an aerosol is generated as the solid material comes in contact with the liquid material in the aerosol generating space; a liquid transfer tube connected to the liquid storage and the aerosol generating space such that the liquid material moves from the liquid storage to the aerosol generating space; and a mouthpiece configured to discharge the aerosol generated in the aerosol generating space, according to a user's inhalation.

Advantageous Effects of Invention

According to the present disclosure, an aerosol is generated by a foaming reaction caused when a certain solid material and a certain liquid material come in contact with each other. Therefore, the aerosol can be provided in a simpler and safer way than a method of controlling power of a heater by using a control element.

The effects of the present disclosure are not limited to the above-described effects, and effects that are not mentioned will be clearly understood by those of ordinary skill in the art from the present specification and the accompanying drawings.

BRIEF DESCRIPTION OF DRAWINGS

FIG. 1 is a schematic diagram illustrating an aerosol generating device according to an embodiment.

FIG. 2 is a perspective view illustrating an aerosol generating device according to an embodiment.

FIG. 3 is a diagram illustrating a solid material according to an embodiment.

FIG. 4 is a diagram illustrating an aerosol generating device including a flow rate regulator according to an embodiment.

FIG. 5 is a diagram illustrating an aerosol generating device including an air inlet passage according to an embodiment.

FIG. 6 is a diagram illustrating an aerosol generating device including a liquid storage and an aerosol generating unit arranged according to an embodiment.

FIG. 7 is a diagram illustrating an aerosol generating device including a recovery portion according to an embodiment.

FIG. 8 is a block diagram illustrating the configuration of hardware of an aerosol generating device according to an embodiment.

BEST MODE FOR CARRYING OUT THE INVENTION

According to an aspect of the present disclosure, an aerosol generating device includes a liquid storage configured to store a liquid material; an aerosol generating space configured to accommodate a solid material including a tobacco material and a foamable material such that an aerosol is generated as the solid material comes in contact with the liquid material in the aerosol generating space; a liquid transfer tube connected to the liquid storage and the aerosol generating space such that the liquid material moves from the liquid storage to the aerosol generating space; and a mouthpiece configured to discharge the aerosol generated in the aerosol generating space, according to a user's inhalation.

The aerosol generating space may be arranged between the liquid storage and the mouthpiece.

The aerosol generating device may further include a cap configured to cover the aerosol generating space and including the mouthpiece.

The cap may be made of a flexible material and configured to cover at least part of a side portion of the aerosol generating space.

The aerosol generating device may further include a gas transfer tube through which the aerosol generated by the aerosol generating space moves to the mouthpiece.

An extension direction of the gas transfer tube and an extension direction of the liquid transfer tube may be parallel to each other.

The aerosol generating device may further include a flow rate regulator configured to regular the flow rate of the liquid material supplied from the liquid storage to the aerosol generating space.

The aerosol generating device may further include a sensor configured to detect the flow of air generated according to the user's puff, and a controller configured to drive the flow rate regulator when the flow of the air is detected.

The aerosol generating device may further include an air inlet passage through which external air is introduced into the aerosol generating space.

The liquid storage may be arranged between the mouthpiece and the aerosol generating space.

The aerosol generating device may further include a recovery portion configured to return the liquid material from the aerosol generating space to the liquid storage.

The solid material may include a coating material that surrounds a tobacco material and a foamable material, and the coating material may be dissolved by the liquid material.

According to another aspect of the present disclosure, a solid material includes a tobacco material and a foamable material mixed with the tobacco material according to a certain composition ration, wherein, as the foamable material comes in contact with the liquid material supplied from the liquid storage to the aerosol generating unit of the aerosol generating device, the foamable material forms bubbles, and the tobacco material is discharged through the mouthpiece in a form of an aerosol.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIG. 1 is a schematic diagram illustrating an aerosol generating device according to an embodiment. Referring to FIG. 1, an aerosol generating device 100 may include a housing 110, a liquid storage 130 for storing a liquid material, an aerosol generating unit 120 that is a space in which an aerosol is generated from a solid material 200, a liquid transfer tube 140 for supplying the liquid material from the liquid storage 130 to the aerosol generating unit 120, and a mouthpiece 160 through which the generated aerosol is discharged, and a gas transfer tube 150 through which the aerosol generated by the aerosol generating unit 120 moves to the mouthpiece 160. The aerosol generating device 100 may omit some of the above-described components or may further include other components than the above-described components.

Briefly, the aerosol generating device 100 may deliver the liquid material stored in the liquid storage 130 to the aerosol generating unit 120 through the liquid transfer tube 140. The solid material 200 accommodated in the aerosol generating unit 120 may cause a foaming reaction as it comes in contact with the liquid material, to generate an aerosol. The generated aerosol may be provided to the user through the mouthpiece 160. Hereinafter, each component will be described in more detail.

The liquid storage 130 may store the liquid material. The liquid material may be a certain material that reacts with a foamable material 240 and a tobacco material 220 (see FIG. 3) included in the solid material 200 to cause a foaming reaction. The liquid material may be a pure material or a mixture of a plurality of materials. For example, the liquid material may include a water-soluble solvent such as water and alcohol, or an organic solvent. In this case, one of the materials that constitute the liquid material may react with the foamable material 240 contained in the solid material 200, and another material thereof may react with the tobacco material 220.

The liquid material in the liquid storage 130 may be replaced. According to an embodiment, the liquid storage 130 may be manufactured in the form of a cartridge which may be detachably coupled to the aerosol generating device 100.

The aerosol generating unit 120 may be a space in which the solid material 200 and the liquid material come in contact with each other such that a foaming reaction occurs and thus an aerosol is generated. The aerosol generating unit 120 may accommodate the solid material 200. The aerosol generating unit 120 may accommodate a preset appropriate amount of the solid material 200, and accordingly, the amount of the aerosol generated by the aerosol generating unit 120 is appropriately limited. The amount of the aerosol generated by the aerosol generating unit 120 may be properly set to an amount that is safe even when it is inhaled according to a single smoking act while providing a satisfactory flavor and feeling of smoking to the user. Components of the solid material 200 will be described in more detail with reference to FIG. 3.

According to an embodiment, the aerosol generating unit 120 may be manufactured in the form of a replaceable cartridge and may be detachably coupled to the aerosol generating device 100.

The liquid transfer tube 140 may supply the liquid material from the liquid storage 130 to the aerosol generating unit 120. The liquid material may move along the liquid transfer tube 140 according to the user's inhalation. The liquid transfer tube 140 may further include the flow rate regulator 145 that controls the flow amount of the supplied liquid material or a pump that provides power for supplying the liquid material, and this will be described in more detail with reference to FIG. 4.

The mouthpiece 160 may be arranged at a proximal end of the aerosol generating device 100 with respect to the user smoking on the aerosol generating device 100. The mouthpiece 160 may be in contact with the user's oral cavity.

Hereinafter, the arrangement relationship between components will be described.

According to an embodiment, the liquid storage 130 may be arranged at a distal end of the aerosol generating device 100 with respect to the user smoking on the aerosol generating device 100, and the aerosol generating unit 120 may be arranged between the liquid storage 130 and the mouthpiece 160. That is, the mouthpiece 160 and the liquid storage 130 may be located in opposite directions from the aerosol generating unit 120.

Thus, the liquid material may be linearly provided to the user in one direction from the liquid storage 130 to the mouthpiece 160 via the aerosol generating unit 120, according to the user's inhalation. Thus, according to this arrangement, the user's inhalation force may be effectively transmitted to the liquid material in the liquid storage 130.

According to an embodiment, the aerosol generating device 100 may include a gas transfer tube 150 through which the aerosol generated by the aerosol generating unit 120 moves to the mouthpiece 160. In this case, an extension direction (Y-axis direction) of the gas transfer tube 150 and an extension direction (Y-axis direction) of the liquid transfer tube 140 may be parallel to each other. Also, the gas transfer tube 150 and the liquid transfer tube 140 may extend along the a-a' extension line. Thus, the user's inhalation force may be effectively transmitted to the gas transfer tube 150 and the liquid transfer tube 140.

FIG. 2 is a perspective view of an aerosol generating device according to an embodiment. Referring to FIG. 2, the appearance of an aerosol generating device 100 may extend along the a-a' extension line and may be easily gripped by the user's hand. The components of the liquid storage 130, the liquid transfer tube 140, and the aerosol generating unit 120 may be arranged in and protected by a housing 110.

A cap 180 may be combined with the proximal end of the aerosol generating device 100. The aerosol generating unit 120 may be combined with the cap 180 and thus sealed. The cap 180 may be made of a flexible material and may cover at least part of a side portion of the aerosol generating unit 120. Alternatively, the cap 180 and the aerosol generating unit 120 may be combined with each other through a fit method. Alternatively, female and male threads may be formed in the cap 180 and the aerosol generating unit 120, and thus may be combined with each other as the cap 180 is rotated.

When the cap 180 is separated from the aerosol generating unit 120, an empty space of the aerosol generating unit 120 may be exposed, and the solid material 200 may be inserted into the empty space of the aerosol generating unit 120 or removed from the empty space of the aerosol generating unit 120.

The mouthpiece 160 and the gas transfer tube 150 may be formed in the cap 180.

FIG. 3 is a diagram illustrating a solid material 200 according to an embodiment. Referring to FIG. 3, the solid material 200 may be a mixture of the tobacco material 220 and the foamable material 240. The tobacco material 220 and the foamable material 240 may be mixed with each other according to a certain composition ratio such that an aerosol may be generated by a foaming reaction caused when the solid material 200 comes into contact with the liquid material.

An aerosol forming process may vary according to the foaming reaction between the solid material 200 and the liquid material. For example, as the foamable material 240 comes into contact with the liquid material, a foaming reaction is caused to collapse the appearance of the solid material 200, and gas components trapped in the solid material 200 may be eluted from the solid material 200 in the form of an aerosol.

For example, as the foamable material 240 comes into contact with the liquid material, a foaming reaction is caused to collapse the appearance of the solid material 200, and the solid tobacco material 220 turns into an aerosol by the foaming reaction with the liquid material. A foaming gas and an aerosolized tobacco material 220 may be eluted from the solid material 200.

The tobacco material 220 may be, for example, obtained by solidifying an extract from a tobacco raw material. For example, the tobacco material 220 may be manufactured by a process of adding a liquid composition to granules obtained from the tobacco raw material and one or more subsequent processes such as a drying process, a grinding process, and a granulation process. The manufacturing process of the tobacco material 220 need not include all of the above-described processes, and some thereof may be omitted, or other processes may be added.

The drying process may include a process such as freeze drying or spray drying.

The grinding process may include grinding, milling, and the like, and the tobacco material 220 may be formed in the form of particles, pellets, rods, films, or powders through the grinding process.

The tobacco material 220 may be manufactured in the form of a refined pill or a tablet through a granulation process, a binder addition process, and a compression process.

For example, the tobacco material 220 may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the tobacco material 220 may include an aerosol forming agent such as glycerin and propylene glycol.

For example, the tobacco material 220 may include any weight ratio of glycerin and propylene glycol solution to which nicotine salts are added. The tobacco material 220 may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the tobacco material 220.

Acid for the formation of the nicotine salts may be appropriately selected in consideration of the rate of nicotine absorption in the blood, the operating temperature of the aerosol generating apparatus 100, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The foamable material 240 may include, for example, a sugar material and an acid/base pair material. The sugar material and the acid/base pair material may be mixed according to a certain ratio considering the amount of an aerosol generated during the foaming reaction.

The sugar material may contain a gas component trapped inside the solid material 200 and may release a gas component when the solid material 200 collapses, and may be provided in the form of granules or particles. Sugar materials may include various monosaccharides (e.g., glucose, fructose, galactose), disaccharides (e.g., sucrose, lactose, maltose), trisaccharides, or oligosaccharides.

The acid/base pair material may be a component for accelerating the foaming reaction of the foamable material 240. For example, the acid/base pair material may be a carbonate and bicarbonate material, including an alkali metal salt or an alkaline earth metal salt. For example, carbonate and bicarbonate base materials may include sodium carbonate, sodium hydrogen carbonate, sodium bicarbonate, potassium carbonate, potassium bicarbonate, magnesium carbonate, calcium carbonate, sodium sesqui carbonate, sodium glycine carbonate, lysine carbonate, arginine carbonate, and mixtures thereof.

According to an embodiment, the solid material 200 may include a coating material 260 that surrounds the tobacco material 220 and the foamable material 240. The coating material 260 may help to maintain the appearance of the solid material 200. The coating material 260 may prevent the foamable material 240 of the solid material 200 from foaming before it comes in contact with the liquid material. The coating material 260 may be dissolved as it comes in contact with the liquid material, and may expose the foamable material 240 and the tobacco material 220 surrounded by the coating material 260.

FIG. 4 is a diagram illustrating an aerosol generating device 100 including a flow rate regulator 145 according to an embodiment. Referring to FIG. 4, an aerosol generating device 100 may include a flow rate regulator 145 that regulates the flow rate of the liquid material supplied from the liquid storage 130 to the aerosol generating unit 120.

The flow rate regulator 145 may start or stop the flow of the liquid material through the liquid transfer tube 140, or may increase or decrease the flow rate.

The flow rate regulator 145 may be controlled manually by the user or automatically by the controller 171 (see FIG. 8). The flow rate regulator 145 may open the liquid transfer tube 140 to allow the user to smoke by supplying the liquid material to the aerosol generating unit 120, and may close the liquid transfer tube 140 after an appropriate amount of the liquid material is supplied to the aerosol generating unit 120.

For example, when the user's puff operation is detected by a puff sensor, the controller 171 may control the flow rate regulator 145 such that the liquid material may be supplied to the aerosol generating unit 120.

The flow rate regulator 145 may have, for example, a shape of a valve located at one point of the liquid transfer tube 140. The flow rate regulator 145 may include a slew valve, a check valve, a pressure reducing valve, and a cock valve.

Alternatively, the flow rate regulator 145 may be, for example, a pump that provides power for supplying the liquid material from the liquid storage 130 to the aerosol generating unit 120. When the aerosol generating device 100 is used, the supply direction of the liquid material through the liquid transfer tube 140 may be in a direction opposite to the gravity and thus, the pump may provide power to facilitate the supply of the liquid material.

FIG. 5 is a diagram illustrating an aerosol generating device including an air inlet passage according to an embodiment. Referring to FIG. 5, an aerosol generating device 100 may include an air inlet passage 162 through which external air is introduced into the aerosol generating unit 120.

The air inlet passage 162 may facilitate the flow of the aerosol when the user inhales the aerosol. The draw resistance may be determined according to the design of the air inlet passage 162.

The air inlet passage 162 may extend from a pore formed in the housing 110 of the aerosol generating device 100 to the aerosol generating unit 120. Thus, the external air may pass through the housing 110, the aerosol generating unit 120, the gas transfer tube 150, and the mouthpiece 160 and then may be provided to the user.

According to an embodiment, a plurality of the air inlet passages 162 may be provided. For example, the air inlet passage 162 may include a first air inlet passage which extends from the housing 110 to the mouthpiece 160 through the aerosol generating unit 120, and a second air inlet passage which extends from the housing 110 to the mouthpiece 160 without passing through the aerosol generating unit 120.

The second air inlet passage may help to provide a sufficient amount of gas inhaled by the user. The first air inlet passage and the second air inlet passage may be designed such that the aerosol and the total amount of gas may be provided according to a preset ratio.

FIG. 6 is a diagram illustrating an aerosol generating device including a liquid storage 130 and an aerosol generating unit 120 arranged according to an embodiment;

Referring to FIG. 6, unlike the examples shown in FIGS. 4 and 5, the aerosol generating unit 120 may be arranged at a distal end, and the mouthpiece 160 may be arranged at a proximal end, and the liquid storage 130 may be arranged between the aerosol generating unit 120 and the mouthpiece 160. That is, the mouthpiece 160 and the aerosol generating unit 120 may be located in opposite directions from the liquid storage 130. Thus, the liquid material may move from the liquid storage 130 to the aerosol generating unit 120 through the liquid transfer tube 140 in a direction of gravity without separate power.

The gas transfer tube 150 that extends from the aerosol generating unit 120 may extend to pass through the liquid storage 130 and may reach the mouthpiece 160.

Although not shown, according to another embodiment, the liquid storage 130 and the aerosol generating unit 120 may extend in series along the Y-axis direction and may be arranged side by side on the X-axis.

FIG. 7 is a diagram illustrating an aerosol generating device 100 including a recovery portion 170 according to an embodiment. Referring to FIG. 7, an aerosol generating device 100 may include the recovery portion 170 that moves the liquid material from the aerosol generating unit 120 back to the liquid storage 130.

The recovery portion 170 may retrieve materials that remain in the aerosol generating unit 120 after the foaming reaction. For example, the material collected by the recovery portion 170 may include the liquid material, the coating material 260 dissolved from the solid material 200, the tobacco material 220 decomposed into granules, and the foamable material 240 that is not involved in the foaming reaction.

The recovery portion 170 may include a first recovery tube 123 that extends from the aerosol generating unit 120, a storage portion 125 that stores residual materials and filters only the liquid material, and a second recovery tube 127 that returns the liquid material filtered from the storage portion 125 to the liquid storage 130.

The recovery portion 170 need not include all of the above-described components and may include only some thereof. The recovery portion 170 may be embedded inside the housing 110 of the aerosol generating device 100, or as an external configuration of the housing 110, it may be mounted and operated in the aerosol generating device 100 when necessary.

FIG. 8 is a block diagram illustrating hardware components of the aerosol generating device according to an embodiment. Referring to FIG. 4, the aerosol generating device 100 may include a battery 172, a sensor 173, a user interface 175, a memory 174, and a controller 171. However, the internal structure of the aerosol generating device 100 is not limited to the structures illustrated in FIG. 8. According to the design of the aerosol generating device 100, it will be understood by one of ordinary skill in the art that some of the hardware components shown in FIG. 8 may be omitted or new components may be added.

The battery 172 supplies electric power to be used for the aerosol generating device 100 to operate. In other words, the battery 172 may supply electric power required for operation of the sensor 173, the user interface 175, the memory 174, and the controller 171. The battery 172 may be a rechargeable battery or a disposable battery. For example, the battery 172 may be a lithium polymer (LiPoly) battery, but is not limited thereto.

The aerosol generating device 100 may include at least one sensor 173. A result sensed by the at least one sensor 173 is transmitted to the controller 171, and the controller 171 may control the aerosol generating device 100 to perform various functions such as controlling the operation of the heater, restricting smoking, determining whether a cartridge is inserted, and displaying a notification.

For example, the at least one sensor 173 may include a puff detecting sensor. The puff detecting sensor may detect a user's puff based on any one of a temperature change, a flow change, a voltage change, and a pressure change.

The user interface 175 may provide the user with information about the state of the aerosol generating device 100. The user interface 175 may include various interfacing devices, such as a display or a light emitter for outputting visual information, a motor for outputting haptic information, a speaker for outputting sound information, input/output (I/O) interfacing devices (for example, a button or a touch screen) for receiving information input from the user or outputting information to the user, terminals for performing data communication or receiving charging power, and communication interfacing modules for performing wireless communication (for example, Wi-Fi, Wi-Fi direct, Bluetooth, near-field communication (NFC), etc.) with external devices.

However, the aerosol generating device 100 may be implemented by selecting only some of the above-described various interfacing devices.

The memory 174 may be a hardware component configured to store various pieces of data processed in the aerosol generating device 100, and the memory 174 may store data processed or to be processed by the controller 171. The memory 175 may include various types of memories, such as random access memory, such as dynamic random access memory (DRAM), static random access memory (SRAM), etc., read-only memory (ROM), electrically erasable programmable read-only memory (EEPROM), etc.

The memory 174 may store an operation time of the aerosol generating device 100, the maximum number of puffs, the current number of puffs, at least one temperature profile, data on a user's smoking pattern, etc.

The controller 171 is a hardware component configured to control general operations of the aerosol generating device 100. The controller 171 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The controller 171 analyzes a result of the sensing by at least one sensor 173, and controls processes that are to be performed subsequently.

The controller 171 may control the flow rate regulator 145 (e.g., a pump) to control the flow of the liquid material based on the result of sensing by at least one sensor 173.

The controller 171 may detect whether the aerosol generating unit 120 and the liquid storage 130 are couple to the aerosol generating device 100, based on the result of sensing by at least one sensor 173.

In an embodiment, the controller 171 may count the number of puffs by using a puff detecting sensor and then may stop the supply of the liquid material when the number of puffs reaches a preset number.

The controller 171 may control the user interface 175 based on the result of the sensing by the at least one sensor 173. For example, when the number of puffs reaches the preset number after counting the number of puffs by using the puff detecting sensor, the controller 171 may notify the user by using at least one of a light emitter, a motor or a speaker that the aerosol generating device 100 will soon be terminated.

In addition, although not shown in FIG. 8, according to an embodiment, the aerosol generating device 100 may include a heater. The heater may be an electrically resistive material and may be a heating element that receives power from the battery 172 to generate heat under control of the controller 171. The aerosol generating device 100 may transfer heat to the solid material 200 through the heater as needed, thereby promoting the generation of an aerosol. For example, the heater may heat the aerosol generating unit 120 or the liquid material at an appropriate temperature such that the aerosol generated from the solid material 200 becomes maximum.

In addition, although not shown in FIG. 8, the aerosol generating device 100 may configure an aerosol generating system together with a separate cradle. For example, the cradle may be used to charge the battery 172 of the aerosol generating device 100. For example, the aerosol generating device 100 may receive power from the battery 171 of the cradle in a state in which the aerosol generating device 100 is accommodated in the aerosol generating unit 120 inside the cradle, so that the battery 172 of the aerosol generating device 100 may be charged.

At least one of the components, elements, modules or units (collectively "components" in this paragraph) represented by a block in the drawings, such as the controller 171 in FIG. 8, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating device comprising:

a liquid storage configured to store a liquid material;

an aerosol generating space configured to accommodate a solid material including a tobacco material and a foamable material such that an aerosol is generated as the solid material contacts with the liquid material in the aerosol generating space;

a liquid transfer tube connected to the liquid storage and the aerosol generating space such that the liquid material moves from the liquid storage to the aerosol generating space; and a mouthpiece configured to discharge the aerosol generated in the aerosol generating space, according to a user's inhalation.

2. The aerosol generating device of claim 1, wherein the aerosol generating space is arranged between the liquid storage and the mouthpiece.

3. The aerosol generating device of claim 1, further comprising a cap configured to cover the aerosol generating space and including the mouthpiece.

4. The aerosol generating device of claim 3, wherein the cap is made of a flexible material and configured to cover at least part of a side portion of the aerosol generating space.

5. The aerosol generating device of claim 1, further comprising a gas transfer tube through which the aerosol generated by the aerosol generating space moves to the mouthpiece.

6. The aerosol generating device of claim 5, wherein an extension direction of the gas transfer tube and an extension direction of the liquid transfer tube are parallel to each other.

7. The aerosol generating device of claim 1, further comprising a flow rate regulator configured to regulate a flow rate of the liquid material supplied from the liquid storage to the aerosol generating space.

8. The aerosol generating device of claim 7, further comprising:

a sensor configured to detect flow of air generated according to the user's inhalation; and a controller configured to drive the flow rate regulator based on the flow of air being detected by the sensor.

9. The aerosol generating device of claim 1, further comprising an air inlet passage through which external air is introduced into the aerosol generating space.

10. The aerosol generating device of claim 1, wherein the liquid storage is arranged between the mouthpiece and the aerosol generating space.

11. The aerosol generating device of claim 1, further comprising a recovery portion configured to return the liquid material from the aerosol generating space to the liquid storage.

12. The aerosol generating device of claim 1, wherein the solid material comprises a coating material surrounding the tobacco material and the foamable material, and configured to be dissolved by the liquid material.

13. A solid material for an aerosol generating device including an aerosol generating space for accommodating the solid material, the solid material comprising:

a tobacco material; and a foamable material mixed with the tobacco material according to a predetermined mixing ratio such that the foamable material foams and the tobacco material is vaporized into an aerosol as the solid material contacts a predetermined liquid material stored in a liquid storage of the aerosol generating device.

14. The solid material of claim 13, wherein the predetermined liquid material is a water-soluble solvent or an organic solvent.

* * * * *